US007432657B2

(12) United States Patent
Bewlay et al.

(10) Patent No.: US 7,432,657 B2
(45) Date of Patent: Oct. 7, 2008

(54) CERAMIC LAMP HAVING SHIELDED NIOBIUM END CAP AND SYSTEMS AND METHODS THEREWITH

(75) Inventors: Bernard Patrick Bewlay, Schenectady, NY (US); Bruce Alan Knudsen, Amsterdam, NY (US); Alan George Chalmers, Akron, OH (US); Mohamed Rahmane, Clifton Park, NY (US); James Scott Vartuli, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 455 days.

(21) Appl. No.: 11/172,651

(22) Filed: Jun. 30, 2005

(65) Prior Publication Data

US 2007/0001611 A1 Jan. 4, 2007

(51) Int. Cl.
*H01J 17/04* (2006.01)
*H01J 61/04* (2006.01)

(52) U.S. Cl. ..... 313/634; 313/318.02; 313/493; 313/635

(58) Field of Classification Search ..... 313/634, 313/635, 489, 490, 493
See application file for complete search history.

(56) References Cited

U.S. PATENT DOCUMENTS

| | | | | |
|---|---|---|---|---|
| 3,363,134 | A | 1/1968 | Johnson | |
| 3,385,463 | A | 5/1968 | Lang | |
| 3,659,138 | A | 4/1972 | Johnson et al. | |
| 3,662,455 | A | 5/1972 | Anderson | |
| 3,693,007 | A | 9/1972 | Kerekes | |
| 3,872,341 | A | 3/1975 | Werner et al. | 313/217 |
| 3,882,344 | A | 5/1975 | Knochel et al. | 313/217 |
| 3,882,346 | A | 5/1975 | McVey | 313/253 |
| 3,953,177 | A | 4/1976 | Sedlatschek et al. | |
| 4,103,200 | A | 7/1978 | Bhalla | 313/221 |
| 4,291,250 | A | 9/1981 | Bhalla | 313/220 |
| 4,409,517 | A | 10/1983 | Van Der Sande et al. | |
| 4,464,603 | A | 8/1984 | McVey | |
| 4,507,584 | A | 3/1985 | Coaton et al. | |
| 4,545,799 | A | 10/1985 | Rhodes et al. | |
| 4,585,972 | A | 4/1986 | Hing | |
| 4,707,636 | A | 11/1987 | Morris | |
| 4,780,646 | A | 10/1988 | Lang | |
| 4,804,889 | A | 2/1989 | Reid et al. | 313/624 |
| 5,057,048 | A | 10/1991 | Feuersanger et al. | |
| 5,321,335 | A | 6/1994 | Klug et al. | |

(Continued)

FOREIGN PATENT DOCUMENTS

EP 0935278 8/1999

(Continued)

OTHER PUBLICATIONS

U.S. Appl. No. 10/952,940, filed Sep. 24, 2004, Bewlay et al.

(Continued)

*Primary Examiner*—Karabi Guharay
*Assistant Examiner*—Bumsuk Won
(74) *Attorney, Agent, or Firm*—Fletcher Yoder

(57) ABSTRACT

A lamp comprising an arc envelope and a niobium end structure coupled to the arc envelope, and wherein the end structure is shielded from a dosing material disposed within the arc envelope.

35 Claims, 9 Drawing Sheets

U.S. PATENT DOCUMENTS

| | | | | |
|---|---|---|---|---|
| 5,424,609 | A | 6/1995 | Geven et al. | |
| 5,426,343 | A | 6/1995 | Rhodes et al. | |
| 5,552,670 | A | 9/1996 | Heider et al. | |
| 5,725,827 | A | 3/1998 | Rhodes et al. | |
| 5,783,907 | A | 7/1998 | Suzuki et al. | |
| 5,973,453 | A | 10/1999 | Van Viet et al. | |
| 5,994,839 | A | 11/1999 | Yamamoto et al. | |
| 6,069,456 | A | 5/2000 | Fromm et al. | |
| 6,126,889 | A | 10/2000 | Scott et al. | |
| 6,215,254 | B1 | 4/2001 | Honda et al. | |
| 6,216,889 | B1 | 4/2001 | Chang | |
| 6,265,827 | B1 | 7/2001 | Takahashi et al. | |
| 6,294,871 | B1 | 9/2001 | Scott et al. | |
| 6,300,716 | B1 | 10/2001 | Honda et al. | |
| 6,375,533 | B1 | 4/2002 | Torikai et al. | |
| 6,404,129 | B1 | 6/2002 | Hendricx et al. | |
| 6,528,945 | B2 | 3/2003 | Kelly et al. | |
| 6,583,563 | B1 | 6/2003 | Venkataramani et al. | |
| 6,635,993 | B1 | 10/2003 | Niimi | |
| 6,642,654 | B2 | 11/2003 | Niimi | |
| 6,657,388 | B2 | 12/2003 | Wijenberg et al. | |
| 6,750,612 | B2 | 6/2004 | Takagaki et al. | |
| 6,781,292 | B2 | 8/2004 | Ishida et al. | |
| 6,791,267 | B2 | 9/2004 | Niimi | |
| 6,812,642 | B1 | 11/2004 | Niimi | 313/623 |
| 6,815,894 | B2 | 11/2004 | Takagaki et al. | |
| 6,873,109 | B2 | 3/2005 | Ishigami et al. | |
| 2002/0027421 | A1 | 3/2002 | Kaneko et al. | |
| 2002/0117965 | A1* | 8/2002 | Kotter et al. | 313/573 |
| 2004/0108814 | A1 | 6/2004 | Tsuda et al. | |
| 2004/0119413 | A1* | 6/2004 | Kebbede et al. | 313/624 |
| 2004/0119414 | A1 | 6/2004 | Bewlay et al. | 313/636 |
| 2004/0124776 | A1* | 7/2004 | Iorio et al. | 313/625 |
| 2004/0135510 | A1 | 7/2004 | Bewlay et al. | 313/624 |
| 2004/0174121 | A1 | 9/2004 | Tsuda et al. | |
| 2004/0183446 | A1 | 9/2004 | Grundmann et al. | |
| 2005/0007020 | A1 | 1/2005 | Tsuda et al. | |
| 2005/0174053 | A1* | 8/2005 | Gunter | 313/567 |
| 2006/0001346 | A1 | 1/2006 | Vartuli et al. | |
| 2006/0008677 | A1 | 1/2006 | Bewlay et al. | |
| 2006/0012306 | A1 | 1/2006 | Bewlay et al. | |
| 2006/0022596 | A1* | 2/2006 | Watanabe et al. | 313/623 |
| 2006/0202624 | A1* | 9/2006 | Ramaiah et al. | 313/625 |

FOREIGN PATENT DOCUMENTS

| | | |
|---|---|---|
| EP | 1150337 | 10/2001 |
| EP | 1158567 | 11/2001 |
| EP | 1172839 | 1/2002 |
| EP | 1172840 | 1/2002 |
| EP | 1220295 | 7/2002 |
| EP | 1253616 | 10/2002 |
| EP | 1296355 | 3/2003 |
| EP | 1351276 | 10/2003 |
| EP | 1363313 | 11/2003 |
| EP | 1434247 | 6/2004 |
| JP | 2004214194 | 7/2004 |
| WO | WO9825294 | 6/1998 |
| WO | WO03058674 | 7/2003 |
| WO | WO03099741 | 12/2003 |
| WO | WO2004023517 | 3/2004 |
| WO | WO2004049390 | 6/2004 |
| WO | WO2004049391 | 6/2004 |
| WO | WO2004051699 | 6/2004 |
| WO | WO2004051700 | 6/2004 |
| WO | WO2004102614 | 11/2004 |

OTHER PUBLICATIONS

U.S. Appl. No. 10/738,261, filed Dec. 17, 2003, Bewlay et al.
U.S. Appl. No. 10/984,593, filed Nov. 9, 2004, Loureiro et al.
U.S. Appl. No. 11/172,649, filed Jun. 30, 2005, Bewlay et al.
U.S. Appl. No. 11/172,650, filed Jun. 30, 2005, Bewlay et al.
U.S. Appl. No. 11/289,128, filed Nov. 29, 2005, Bewlay et al.
Tokumatsu Tachiwaki et al., "*Novel Synthesis of $Y_3Al_5O_{12}$ (YAG) Leading to Transparent Ceramics*", Solid State Communications, vol. 119, pp. 603-606, 2001.
Lei Wen et al., "*Synthesis of Nanocrystalline Yttria Powder and Fabrication of Transparent YAG Ceramics*", Journal of the European Ceramic Society, vol. 24, pp. 2681-2688, 2003.
D. Hreniak et al., "*Synthesis and Optical Properties of $Nd^3$ + —Doped $Y_3Al_5O_{12}$ Nanoceramics*", Journal of Alloys and Compounds, vol. 341, pp. 183-186, 2002.
Guanshi Qin et al., "*Upconversion Luminescence of $Er^3$ + In Highly Transparent YAG Ceramics*", Solid State Communications, vol. 132, pp. 103-106, 2004.
Jianren Lu et al., "*Neodymium Doped Yttrium Aluminum Garnet ($Y_3Al_5O_{12}$) Nanocrystalline Ceramics—A New Generation of Solid State Laser and Optical Materials*", Journal of Alloys and Compounds, vol. 341, pp. 220-225, 2002.
A.K. Pradhan et al., "*Synthesis of Neodymium-Doped Yttrium Aluminum Garnet (YAG) Nanocrystalline Powders Leading to Transparent Ceramics*", Materials Research Bulletin, vol. 39, pp. 1291-1298, 2004.

* cited by examiner

CERAMIC LAMP HAVING SHIELDED NIOBIUM END CAP AND SYSTEMS AND METHODS THEREWITH

BACKGROUND

The present technique relates generally to the field of lighting systems and, more particularly, to high intensity discharge lamps.

High intensity discharge lamps are often formed from a ceramic tubular body or arc tube that is sealed to one or more end caps or end structures. High intensity discharge lamps generally operate at high temperatures and high pressures. Because of operational limitations, various parts of these lamps are made of different types of materials. The process of joining different materials in high-temperature lamps creates significant challenges. Specifically, the different thermal coefficients of expansion of these joined materials can lead to thermal stresses and cracks during operation of the lamp. For example, thermal stresses and cracks can develop at the seal interface between the different components, e.g., arc tube, electrodes, end caps, and so forth. Certain end-cap materials used to provide favorable and reliable stress distribution in the ceramic at the end of the ceramic lamp unfortunately are not chemically resistant to halide species that may be used in the lamps, especially at elevated temperatures.

Typically, high intensity discharge lamps are assembled and dosed in a dry box, which facilitates control of the atmosphere. For example, in the controlled environment within the dry box, the lamp end-caps are attached to an arc tube with the assistance of a furnace, which is also disposed within the dry box. The assembly of seal material, end-caps and arc tube is inserted into a furnace and the furnace is operated through a controlled temperature cycle. The controlled temperature cycle is designed in conjunction with a temperature gradient at the end of the furnace to melt the seal material (typically a dysprosia-alumina-silica mixture), which then flows through the gap between components to seal the end-caps to the arc tube. Typically a furnace such as a large muffle type furnace with temperatures reaching to about 1500 degrees centigrade or higher is used. The assembly is typically held at the temperature for about 30 seconds to about 45 seconds, then the temperature of the assembly is brought down to room temperature to seal the end structures to the arc envelope. Unfortunately, this requirement of a dry box environment with a furnace disposed within the box severely limits production efficiency of the lamps. For some lamp applications, it is desirable to have a room temperature pressure of 10 to 20 atmospheres to better enable rapid start-up. Dry box processing makes it difficult to seal lamps with such high pressure fills.

Accordingly, a technique is needed to address one or more of the foregoing problems in lighting systems, such as high-intensity discharge lamps.

BRIEF DESCRIPTION

Embodiments of the present invention provide a ceramic lamp with a protected niobium end structure capable of improved performance, such as light output, color stability, reliability, and life, over the existing traditional technologies. Certain embodiments of the lamp have an arc envelope and a niobium end structure bonded to the arc envelope and shielded from the dosing material disposed within the arc envelope. Another embodiment is a system which has an arc envelope bonded to a niobium end structure which is shielded from the dosing material disposed within the arc envelope. In another embodiment, the present technique includes the method for making a lamp with an arc envelope bonded to a niobium end structure, which is shielded from the dosing material disposed within the arc envelope. In a further embodiment, the present technique includes a method for operating a lamp with an arc envelope bonded to a niobium end structure, which is shielded from the dosing material disposed within the arc envelope.

DRAWINGS

These and other features, aspects, and advantages of the present invention will become better understood when the following detailed description is read with reference to the accompanying drawings in which like characters represent like parts throughout the drawings, wherein.

Figure 3:
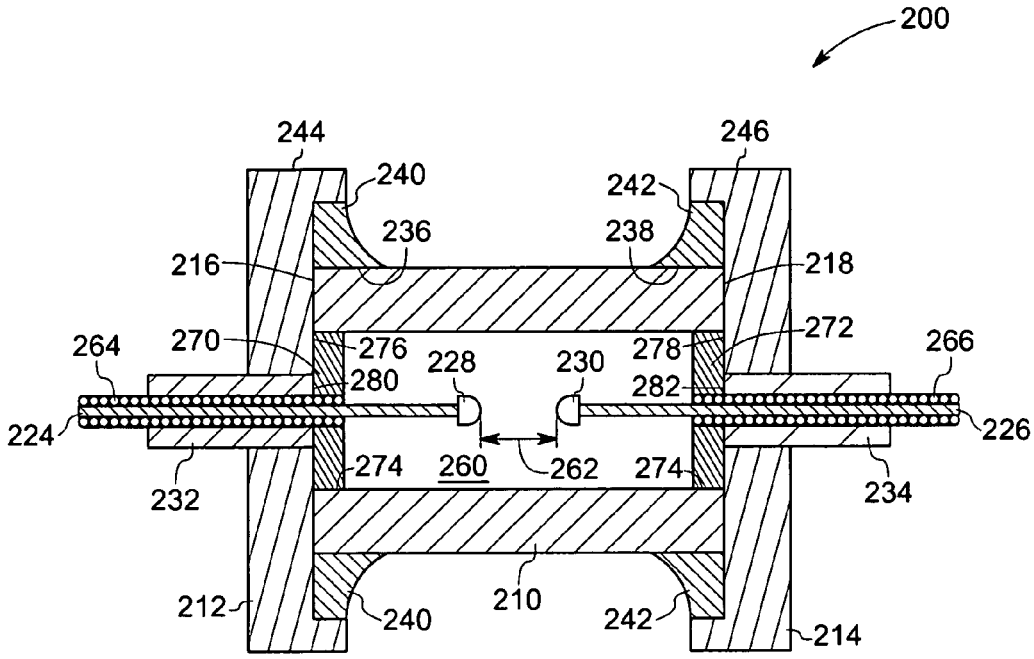
FIG. 3 is a cross sectional view of a lamp having an arc envelope, end structures coupled to and about opposite ends of the arc envelope, a dosing tube coupled to each end structure, and shielding member disposed between each end structure and an interior of the arc envelope in accordance with embodiments of the present technique.
Figure 9:
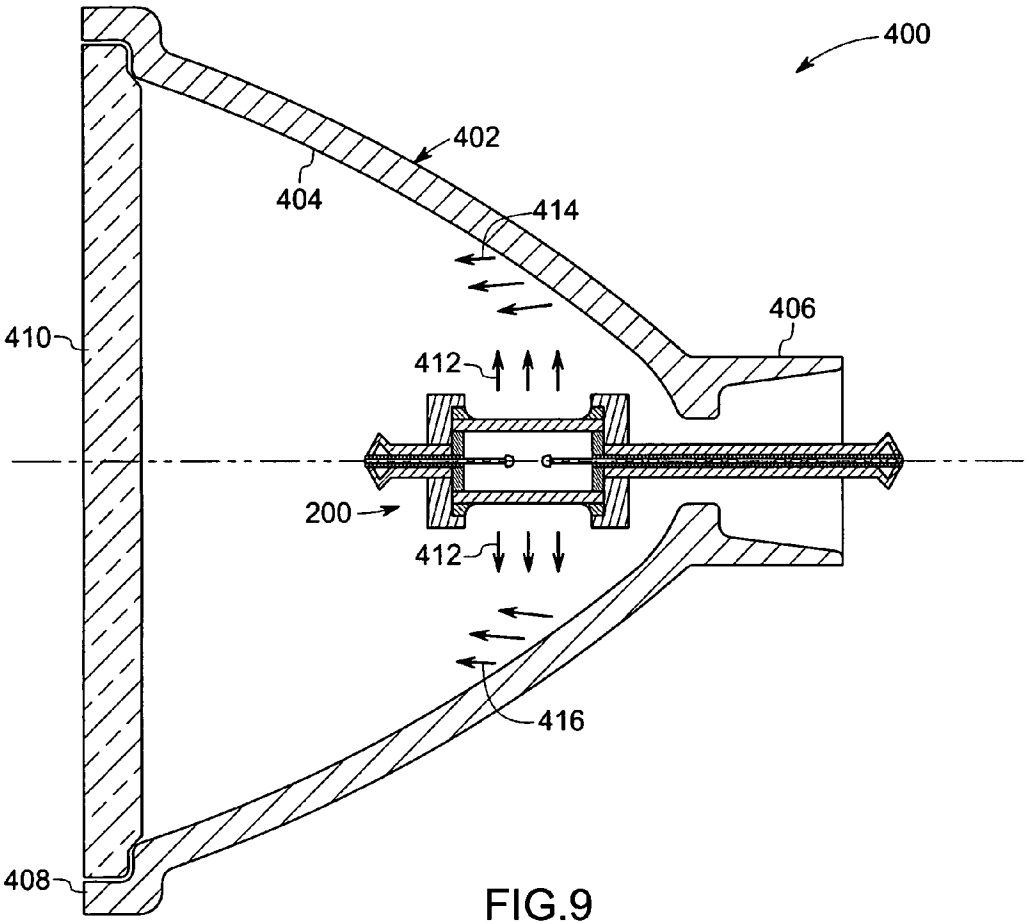
Figure 10:
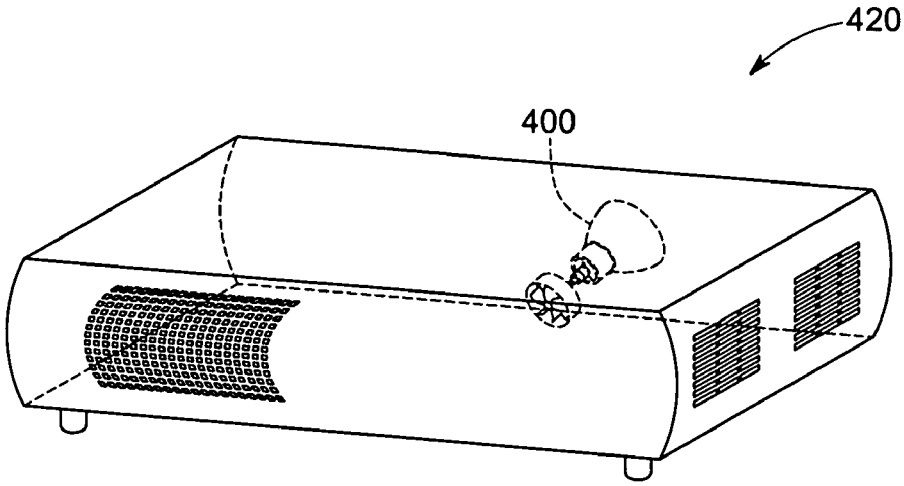
Figure 11:
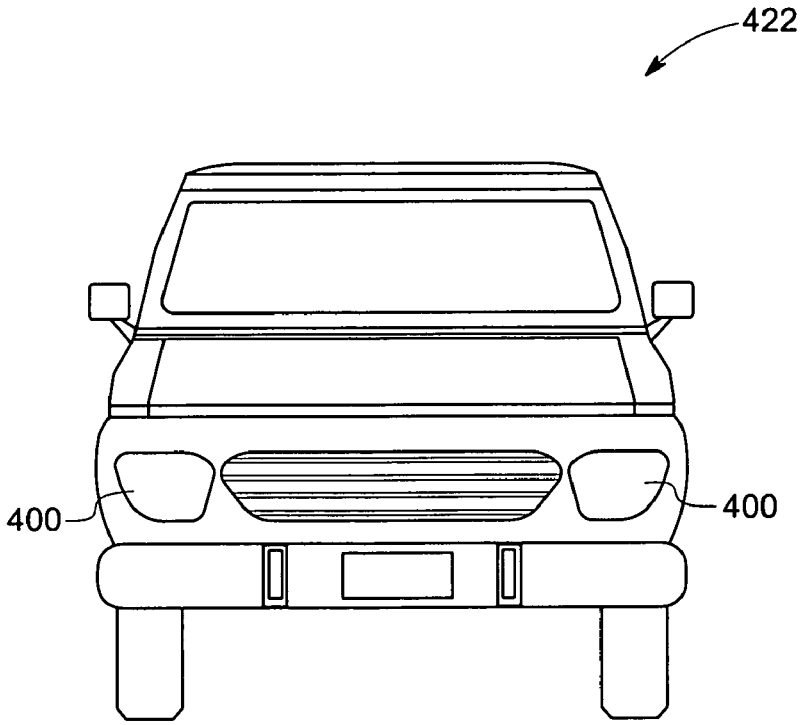
Figure 12:
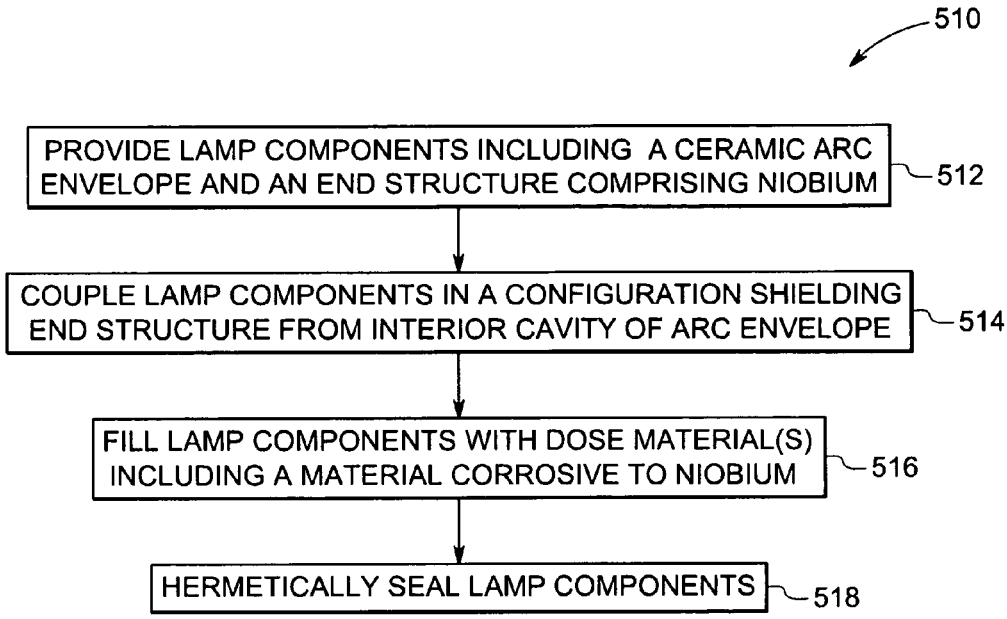
Figure 13:
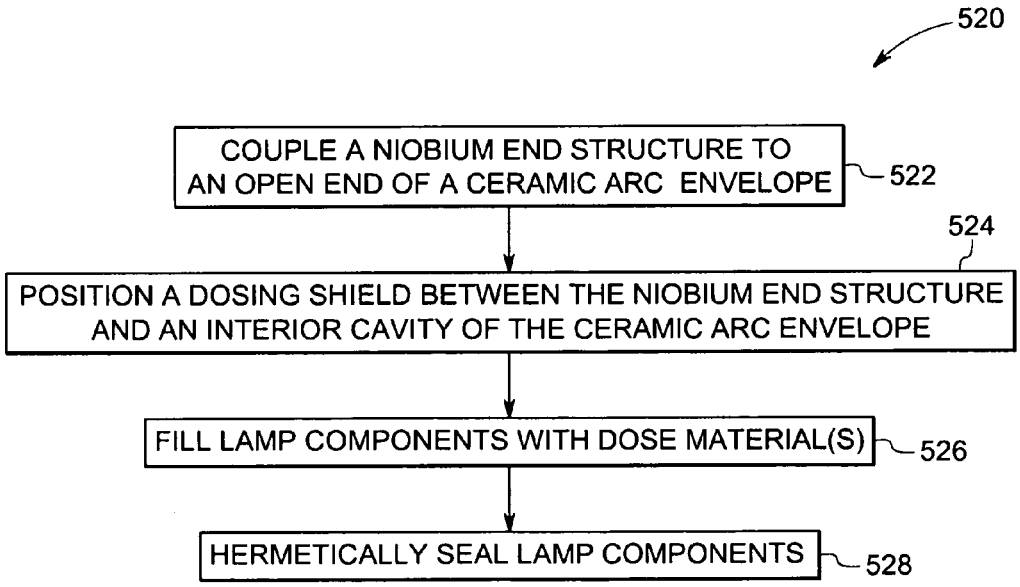
Figure 14:
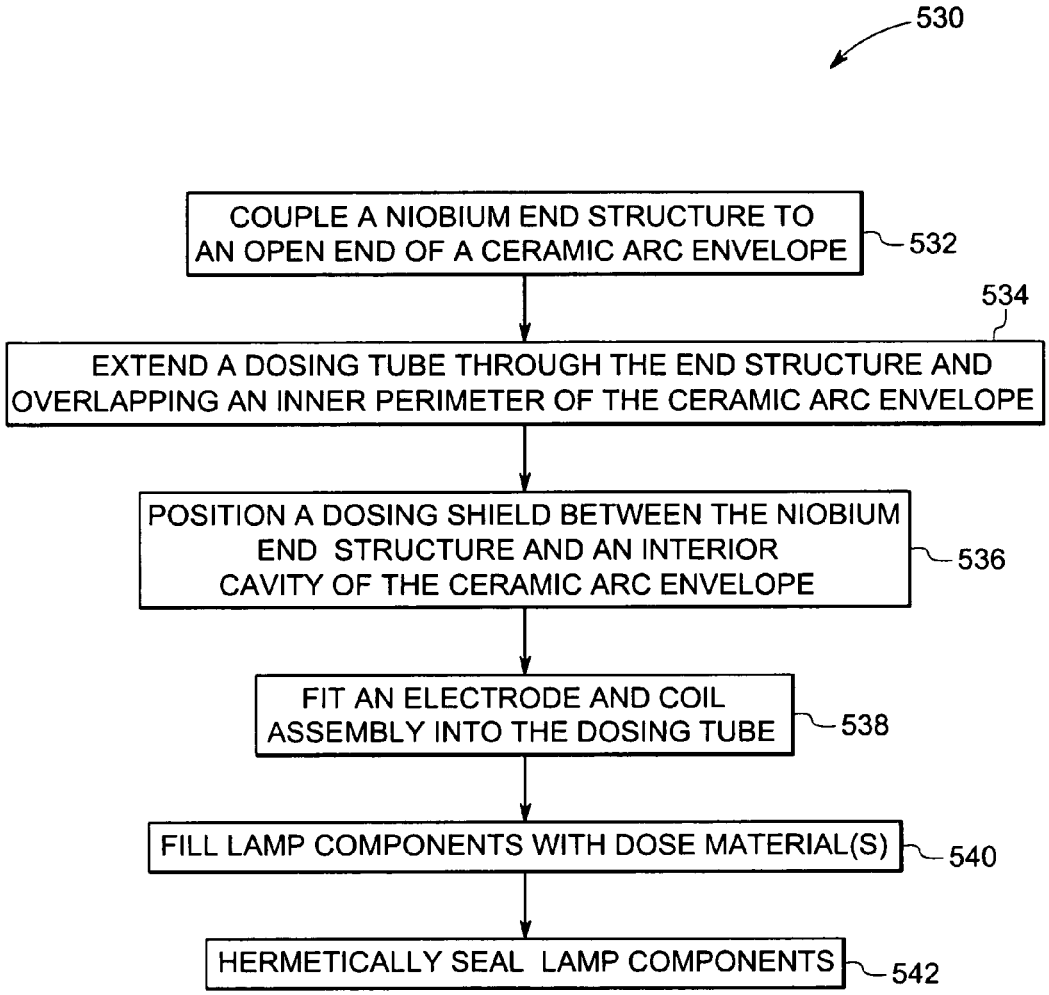
Figure 15:
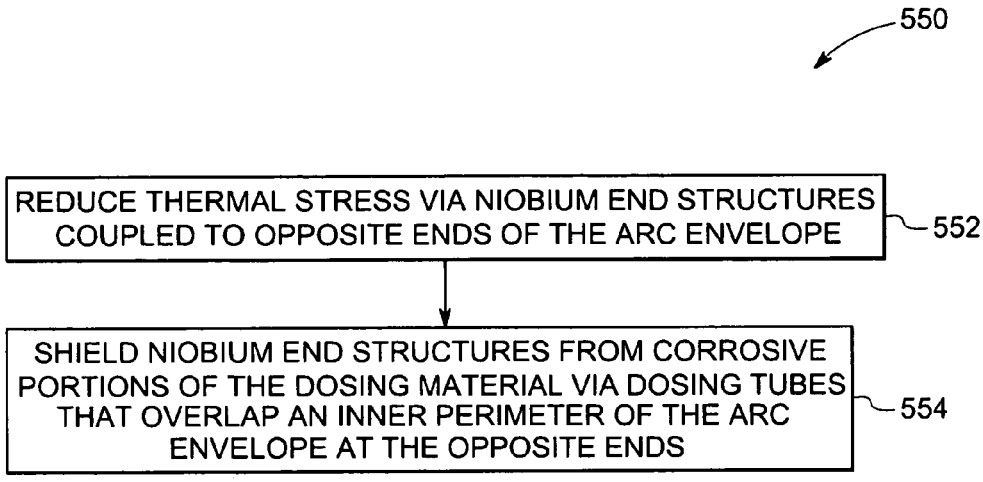
Figure 16:
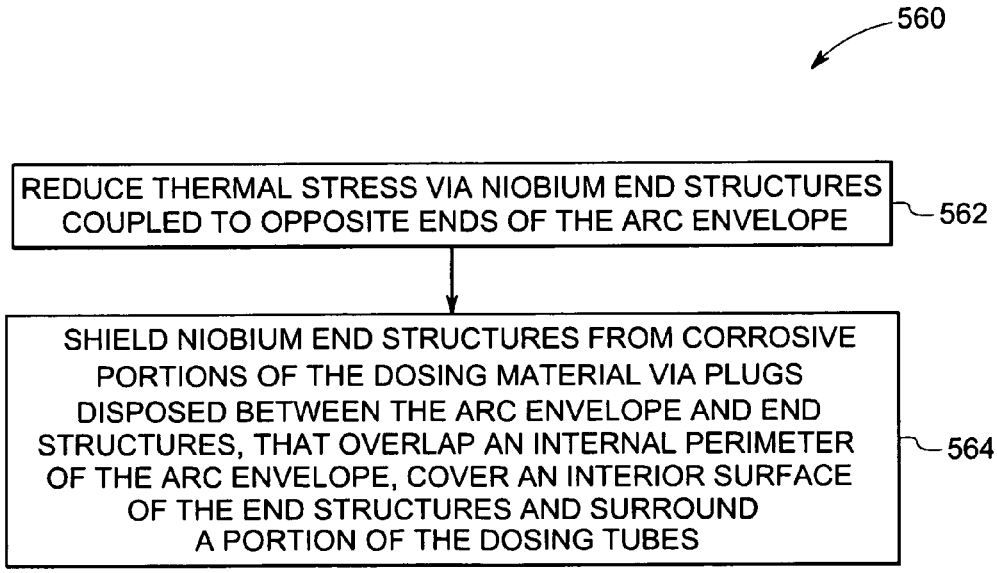

FIGS. 5, 6, 7, and 8 are cross sectional views of the lamp illustrated in FIG. 3 further illustrating certain aspects of a method of manufacturing the lamp in accordance with embodiments of the present technique;

FIG. 9 is a cross sectional view of an automotive headlamp assembly having a lamp in accordance with certain embodiments of the present technique;

FIG. 10 is a perspective view of an video projection system having a lamp in accordance with certain embodiments of the present technique;

FIG. 11 is perspective view of a vehicle, such as an automobile, having a lamp in accordance with certain embodiments of the present technique;

FIGS. 12, 13, and 14 are flowcharts illustrating various methods of manufacturing a lamp in accordance with certain embodiments of the present technique; and FIGS. 15 and 16 are flowcharts illustrating various methods of operating a lamp in accordance with certain embodiments of the present technique.

DETAILED DESCRIPTION

Embodiments of the present technique provide unique ceramic arc lamps comprising an arc envelope having a niobium end structure, which improves performance and mechanical stability of the lamp. The metallic end structure design also desirably provides better thermal stress management during lamp start-up and better thermal management of cold spot temperature. In addition, these lamps are configured to protect the niobium end structure from corrosive dosing materials, such as halides, disposed inside the arc envelope of the lamps. In certain embodiments, these lamps include dosing tubes to facilitate dosing outside of a hot furnace and dry box environment. The unique features introduced above are described in detail below with reference to figures of several exemplary embodiments of the present technique.

Figure 1:
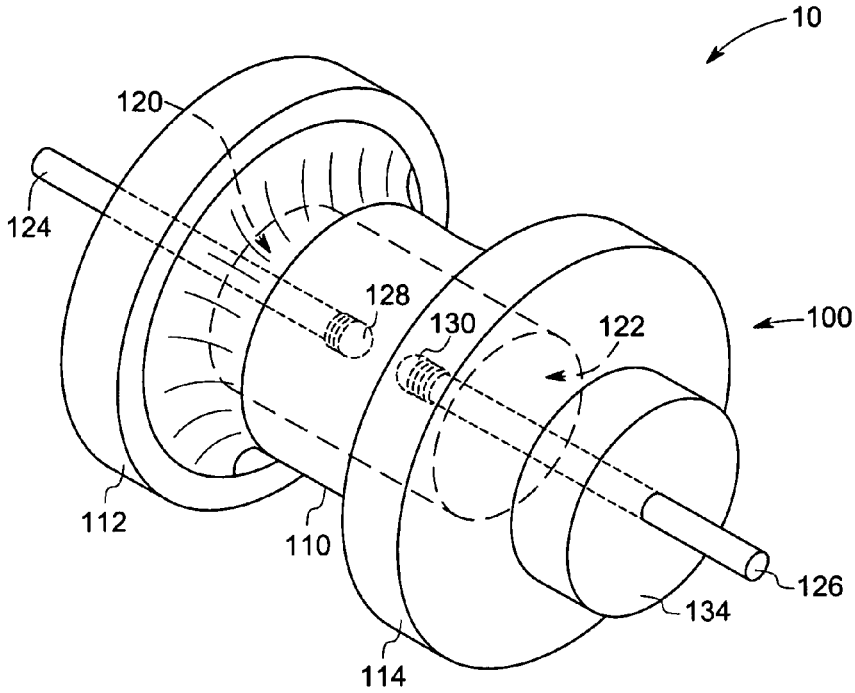
FIG. 1 is a perspective view of an exemplary lamp of the present technique.

Turning now to the drawings, FIG. 1 is a perspective view of a lamp 10 in accordance with certain embodiments of the present technique. As illustrated, the lamp 10 comprises a hermetically sealed assembly of a hollow body or arc envelope assembly 100. As discussed in further detail below, the arc envelope assembly 100 comprises an arc envelope 110 and niobium end structures 112 and 114 coupled to opposite ends 116 and 118 of the arc envelope 110 with a geometrical configuration and/or shielding structure, which shields the end structures 112 and 114 at opposite openings 120 and 122 of the arc envelope 110 from a dosing material disposed within the arc envelope 110. The arc envelope assembly 100 also includes electrodes 124 and 126 having arc tips 128 and 130, respectively. These electrodes 124 and 126 are mounted inside the dosing tubes 132 and 134 that extend through the end structures 112 and 114, respectively. These and other components of the lamp 10 are formed from a variety of materials, which are either identical or different from one another. For example, different embodiments of the arc envelope 110 are formed from a variety of transparent ceramics and other materials, such as micrograin polycrystalline alumina, alumina, single crystal sapphire, yttria, spinel, ytterbia and rare-earth aluminum garnets. Some useful (colorless) rare earth aluminum garnets include yttrium aluminum garnet, ytterbium aluminum garnet, lutetium aluminum garnet, and chemical combinations of such rare earth aluminum garnets. Other embodiments of the arc envelope 110 are formed from conventional lamp materials such as polycrystalline alumina (PCA). Regarding the geometry of the lamp 10, certain embodiments of the arc envelope 110 comprise a hollow cylinder, a hollow oval shape, a hollow sphere, a bulb shape, a rectangular shaped tube, or another suitable hollow transparent body.

The niobium end structures 112 and 114 of the arc envelope assembly 100 are formed from suitable materials comprising niobium, such as niobium and niobium alloys. End structures desirably provide stress distribution in the ceramic at the ends of the ceramic arc envelope. For example, niobium has a coefficient of thermal expansion that closely matches common arc envelope materials such as alumina and yttria aluminum garnet (YAG) and desirably reduces thermal shock enabling rapid thermal cycling operations including rapid heat up and re-start of the lamp. Unfortunately, niobium is not chemically resistant to certain dosing materials such as halide species that are often used in lamps with operating temperatures above 600° C. In certain embodiments, the niobium end structures 112 and 114 are shielded from the dosing material. For certain embodiments, the dosing material encapsulated by the arc envelope 100 comprises a rare gas and mercury. In certain other embodiments, the dosing material is mercury-free. Further embodiments of the dosing material include materials such as but not limited to metals, or halides such as bromides, chlorides and iodides, or metal halides such as rare-earth metal halides, or any combinations thereof. At least a portion of the dosing material, typically the metal portion, emits radiation in a desired spectral range in response to being excited by the electrical discharge. Although corrosive, many of the dosing materials are desirably efficient radiation emitters. The niobium end structures 112 and 114 may be protected or shielded from chemical attack by these corrosive dosing materials, e.g., halide, by isolating the surface of the end structures 112 and 114 as discussed in further detail below. In some embodiments, the niobium end structures 112 and 114 act as a radiation shield to reflect radiation emitted from within the arc envelope 110 back into and outwardly from the arc envelope 110. The lamp 10 may include a variety of additional structures such as reflectors and lens shaped structures to focus and direct light from the arc envelope assembly 100.

Figure 2:
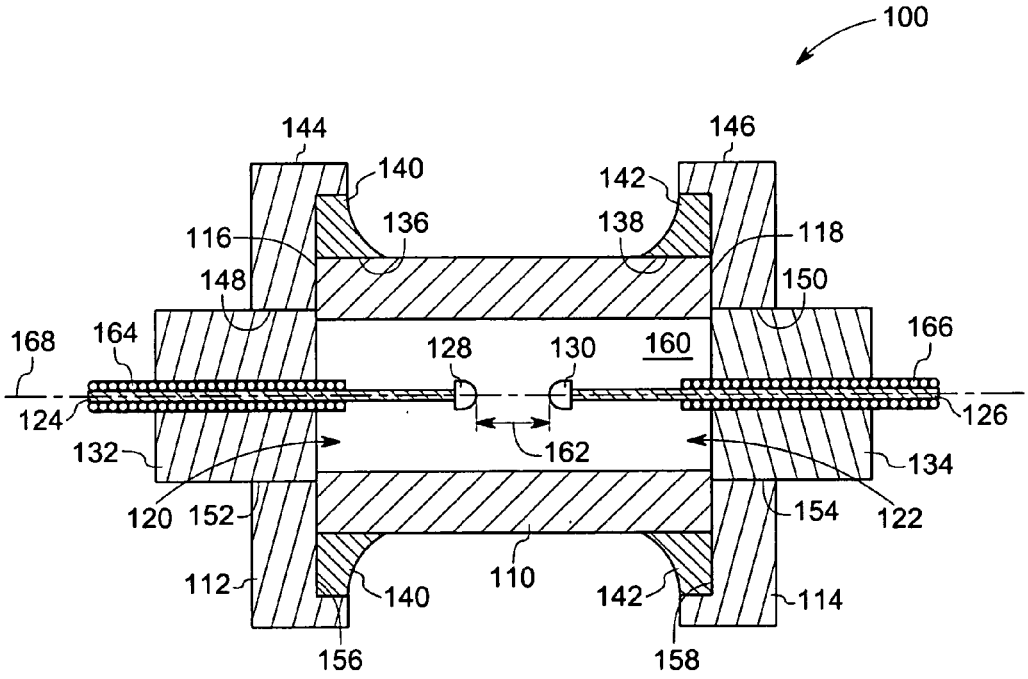
FIG. 2 is a cross-sectional view of a lamp having an arc envelope, end structures coupled to and about opposite ends of the arc envelope, and a dosing tube coupled to each end structure in a configuration shielding the end structure from an interior of the arc envelope in accordance with embodiments of the present technique.

FIG. 2 is a cross-sectional view of the arc envelope assembly 100 in accordance with certain embodiments of the present technique. Again, the arc envelope assembly 100 comprises a hermetically sealed assembly of the hollow body or arc envelope 110 and niobium end structures 112 and 114 coupled to opposite ends 116 and 118 of the arc envelope 110. The niobium end structures 112 and 114 may include niobium, niobium-zirconium alloys such as Nb-1Zr (1% zirconium), niobium-titanium alloys or other materials comprising niobium. In the illustrated embodiment, the end structures 112 and 114 abut the ends 116 and 118 and extend or wrap around outer circumferential portions 136 and 138 of the arc envelope 110. In addition, a compliant seal material 140 and 142 is applied between outer lips or wrapping portions 144 and 146 of the end structures 112 and 114 and outer circumferential portions 136 and 138 of the arc envelope 110. A compliant seal material acts as a spring like material, enabling reduction of thermal shock and stress, especially under rapid temperature change or rapid thermal cycling conditions. Cold spots in a lamp are desirably avoided as dosing material may condense on these spots. Cold spots are found away from the discharge arc, typically in the vicinity of the end structures and dosing tubes. Desirably, a seal material used to seal the end structures to the arc envelope and the wrapping portions of the end structure, enable uniform heat distribution in the arc envelope assembly, which helps control cold spots. The seal materials 140 and 142 can include a sealing glass, such as calcium aluminate, dysprosia-alumina-silica (DAS), magnesia-alumina-silica, yttria-alumina-silica (YAS), or yttria-calcia-alumina. The sealing operation can be performed in an isothermal sintering furnace using a designed seal process cycle. In embodiments, where RF heating is used in the sealing operation, the niobium end structures 112 and 114 can be the susceptor. A susceptor desirably acts as a thermal collection and distribution device, which when heated by a source refocuses the heat to melt the sealing material. Other sealing techniques such as temperature gradient sealing or laser sealing may also be desirably used to seal the niobium end-structure to the ceramic arc envelope.

The arc envelope assembly 100 of FIG. 2 includes electrodes 124 and 126 having arc tips 128 and 130, respectively. The arc envelope assembly 100 also includes dosing tubes 132 and 134 mounted to a passage 148 and 150 through the end structures 112 and 114. As discussed in detail below, these dosing tubes 132 and 136 facilitate insertion of dosing materials into the arc envelope 110. In the illustrated embodiment, the dosing tubes 132 and 134 comprise an outer perimeter 152 and 154 that overlaps the openings 120 and 122 in the opposite ends 116 and 118 of the arc envelope 110, respectively. In this manner, the dosing tubes 132 and 134 isolate or separate the surface 156 and 158 of the end structures 112 and 114 from the interior 160 of the arc envelope 110, thereby shielding or protecting the niobium end structures 112 and 114 from the corrosive dosing material. In some embodiments, the dosing tube comprises a molybdenum-rhenium material. A molybdenum-rhenium material has the advantage of being resistant to corrosive dosing and is sufficiently ductile to allow sealing via a crimping process, a cold welding process, or any other suitable mechanical deformation technique.

In certain embodiments, the electrodes 124 and 126 comprise tungsten or molybdenum. However, other materials are within the scope of the present technique. The electrodes 124 and 126 are mounted to the dosing tubes 132 and 134, such that the arc tips 128 and 130 are separated by a gap 162 to create an arc during operation. Advantageously, the position of the electrodes 124 and 126 can be adjusted lengthwise through the dosing tubes 132 and 134 to attain the desired gap 162 with relatively high precision.

The illustrated arc envelope assembly 100 also includes coils 164 and 166 surrounding the electrodes 124 and 126 within the dosing tubes 132 and 134, respectively. The coils 164 and 166 support the electrodes 124 and 126 in a radial direction within the dosing tubes 132 and 134 respectively, while also permitting some freedom of axial movement and stress relaxation of the respective components. In certain embodiments, the coils 164 and 166, each comprises a molybdenum-rhenium coil assembly having a molybdenum-rhenium mandrel with a molybdenum-rhenium wire overwrap that is continuously wound on the mandrel. In certain embodiments, the electrode is disposed within or on the coil. In certain other embodiments, the electrode is disposed within, and attached or welded to the coil. In some embodiments, the electrode is attached or welded to one end of the coil. In a further embodiment, electrode assemblies comprising tungsten electrodes 124 and 126 welded to molybdenum-rhenium coils 164 and 166 respectively are fitted into molybdenum-rhenium dosing tubes 132 and 134 respectively. The molybdenum-rhenium coil assembly eases insertion into the molybdenum-rhenium tube and presents a compliant structure, which can help manage the thermal stresses on heat up and cool down of the lamp. The compliant nature of the molybdenum-rhenium coil enables it to yield and accommodate under varying stress conditions. This compliant nature allows precise arc gap 162 control during assembly of the lamp.

In the illustrated embodiment, the arc tips 128 and 130 are oriented along the centerline 168 of the arc envelope 110. However, alternative embodiments of the electrodes 124 and 126 position the arc tips 128 and 130 offset from the centerline 168, such that the arc created during operation is substantially centered within the arc envelope 110. For example, alternative electrodes 128 and 130 may be angled outwardly from the centerline 168 and/or mounted to the end structures 112 and 114 at positions offset from the centerline 168.

FIG. 3 is a cross-sectional view of the arc envelope assembly 200 in accordance with certain embodiments of the present technique. As illustrated, dosing shields 270 and 272 are disposed at least partially between the arc envelope 210 and end structures 212 and 214 respectively. In the illustrated embodiment, dosing shields 270 and 272 comprise plugs that overlap an internal perimeter 274 of the arc envelope 210, covers an interior surface 276 and 278 of the end structures 212 and 214, and surrounds a portion 280 and 282 of the dosing tubes 232 and 234 respectively. In this manner, the dosing shields 270 and 272 block or isolate the dosing materials, including corrosive dosing materials (e.g., halides), inside the arc envelope 110 from the niobium material of the end structures 212 and 214. Certain dosing materials such as sodium iodide, although corrosive to end structure materials such as niobium, are efficient radiation emitters. Thus, the lamp has the advantages of the niobium material used in the end structures 212 and 214 and, also the advantages of the corrosive dosing materials. Ceramics including microgram polycrystalline alumina, alumina, single crystal sapphire, yttria, spinel, ytterbia and rare-earth aluminum garnets may be used as shield or plug material. Rare earth (RE) aluminum garnets ($RE_3Al_5O_{12}$), where RE is one or combination of yttrium, cerium, praseodymium, neodymium, samarium, europium, gadolinium, terbium, dysprosium, holmium, erbium, thulium, ytterbium, lutetium, may also be used to form dosing shields. Metal or metal alloys such as molybdenum, molybdenum-rhenium alloy may also be used as shield material. Cermets including a combination of ceramics such as microgram polycrystalline alumina, alumina, single crystal sapphire, yttria, spinel, ytterbia, rare-earth aluminum garnets and metals such as molybdenum, rhenium, may also be used as shield material.

Figure 4:
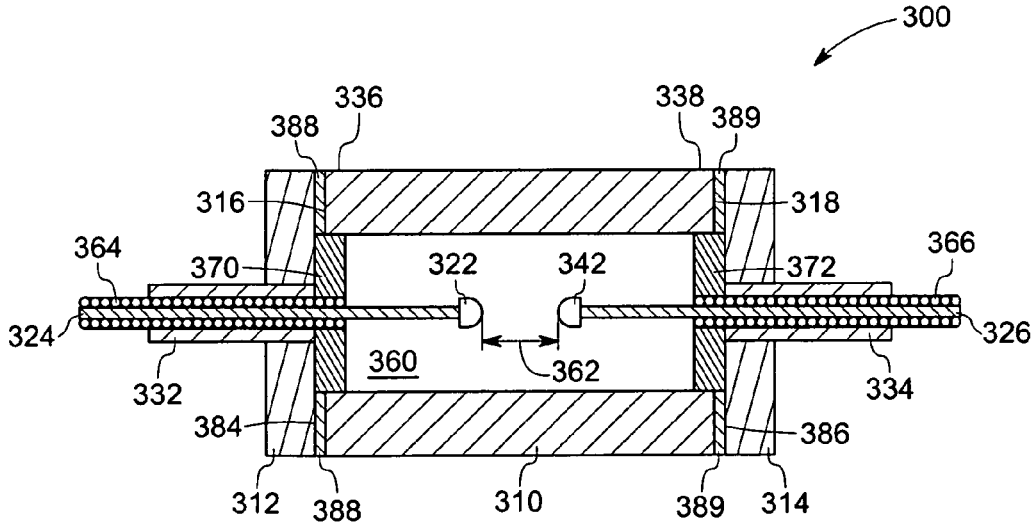
FIG. 4 is a cross sectional view of a lamp having an arc envelope, end structures butt-sealed to opposite ends of the arc envelope, a dosing tube coupled to each end structure, and shielding member disposed between each end structure and an interior of the arc envelope in accordance with embodiments of the present technique.

FIG. 4 is a cross-sectional view of the arc envelope assembly 300 in accordance with certain embodiments of the present technique. Again, the dosing shields 370 and 372 are disposed between the arc envelope and the niobium end structures 312 and 314 respectively. In the illustrated embodiment, the end structures 312 and 314 have a substantially flat mating surfaces 384 and 386 which seal against the opposite ends 316 and 318 without wrapping around the outer circumference 336 and 338 of the arc envelope 310. In other words, the ends structures 312 and 314 butt-seal or form an end-to-end seal against the opposite ends 316 and 318. In certain embodiments, the end structures 312 and 314 are bonded to opposite ends 316 and 318 of the arc envelope 310 using a seal material. Localized heating (e.g., a laser) may be applied to the interface between the end structures 312 and 314 and the opposite ends 326 and 346 to further bond the materials together, thereby forming hermetical seals 388 and 389.

FIGS. 5-8 are cross-sectional side views of the arc envelope assembly 200 illustrated in FIG. 3 further illustrating a material dosing and sealing process in accordance with embodiments of the present technique. However, the process is also applicable to other forms of the arc envelope assembly 100 and 300, such as those illustrated in FIGS. 2 and 4 respectively. In the illustrated embodiment of FIG. 5, the arc envelope assembly 200 has two dosing tubes 232 and 234, only one of which is desired for injecting the dosing material into the arc envelope assembly 200. As discussed in further detail below, the dosing tubes 232 and 234 of FIG. 3 are sealed about the coils 264 and 266 and the electrodes 224 and 226 respectively. In certain embodiments, sealing is achieved by cold-welding the dosing tubes 232 and 234 about the coils 264 and 266 and the electrodes 224 and 226 respectively. For example, a crimping tool may compress the dosing tubes 232 and 234 about the coils 264 and 266 and the electrodes 224 and 226, respectively. In other embodiments, the sealing is achieved by applying localized heat, such as a laser beam, onto the dosing tubes 232 and 234, the coils 264 and 266, and the electrodes 224 and 226, respectively. In some embodiments, a seal material may be used to hermetically join the dosing tubes 232 and 234 to the end structures 212 and 214 and/or the arc envelope 210.

Figure 5:
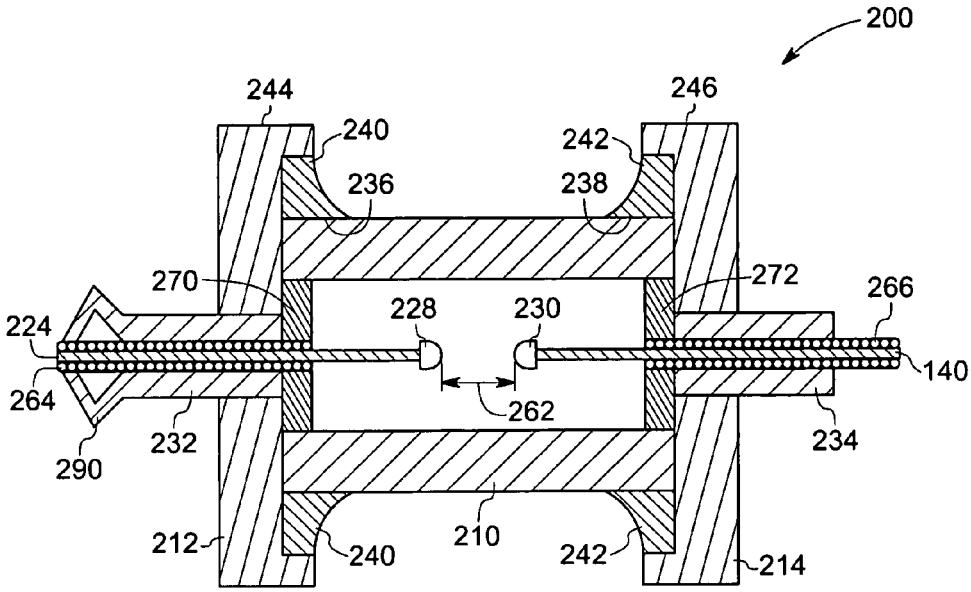
Figure 6:
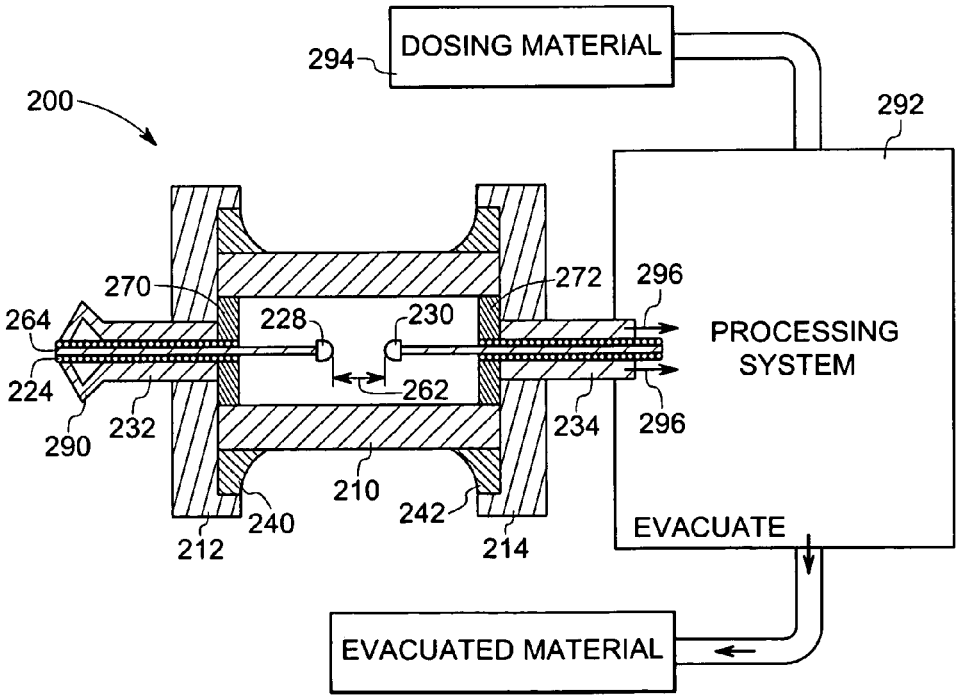
Figure 7:
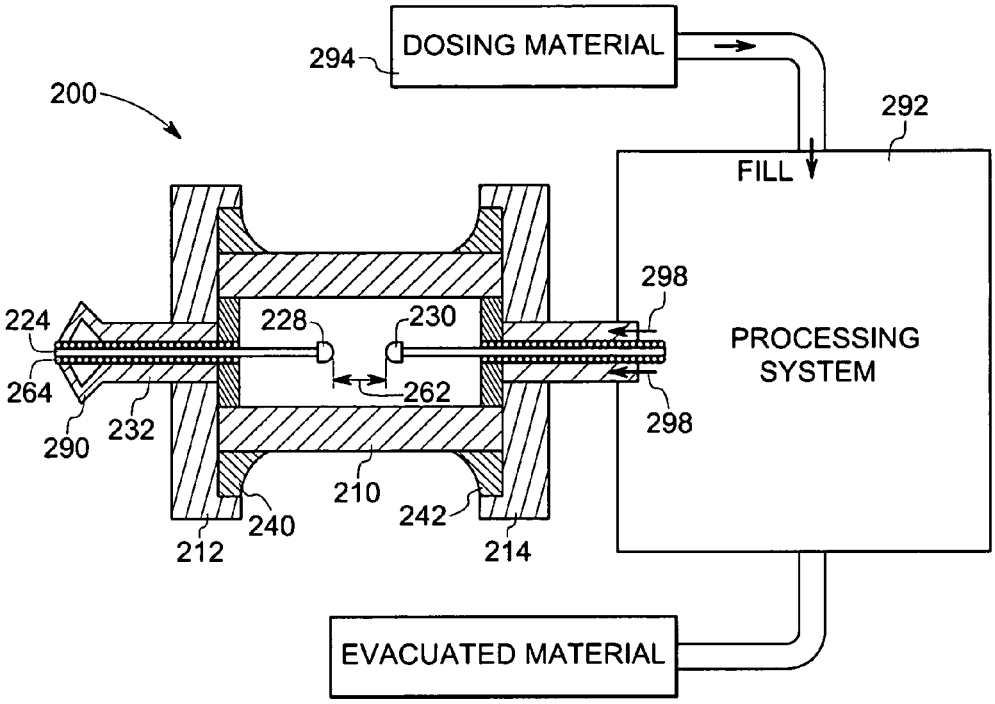

Accordingly, as illustrated in FIG. 5, the dosing tube 232 is closed via a cold welding or crimping operation to form a hermetical seal 290. For example, the dosing tube 232 may embody a molybdenum-rhenium alloy, which is mechanically compressed via a crimping tool or other mechanical deformation tool. Desirably, heat can also be applied (e.g., a laser weld) to facilitate a stronger bond at the hermetical seal 290. Once the dosing tube 232 is sealed at the hermetical seal 290, the arc envelope assembly 200 may be coupled to one or more processing systems, to provide a desired dosing material in the arc envelope assembly 200. In the illustrated embodiment of FIG. 6, the processing system 292 operates to evacuate any substance currently in the arc envelope 210, as indicated by arrows 296. For example, tubing can be connected between the processing system 292 and the dosing tube 234. Once the arc envelope assembly 200 is evacuated, the processing system 292 proceeds to inject one or more dosing materials 294 into the arc envelope 210, as illustrated by arrows 298 shown in FIG. 7. For example, the dosing materials may comprise a rare gas, mercury, a halide, and so forth.

Figure 8:
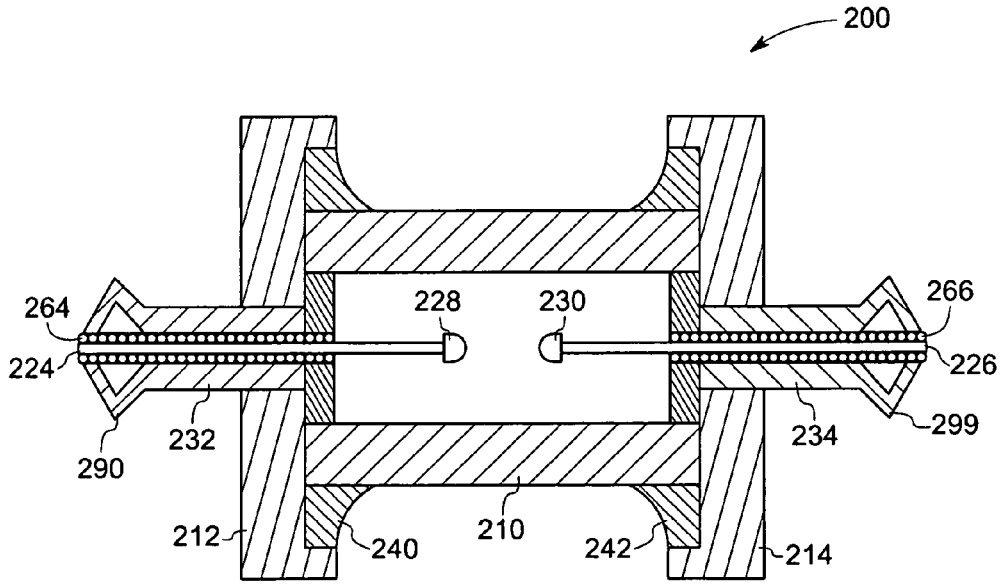

Furthermore, the dosing materials 294 may be injected into the arc envelope 210 in the form of a gas, a liquid, or a solid, such as a dosing pill. After the desired dosing materials have been injected into the arc envelope 210, the present technique proceeds to close the remaining dosing tube 234, as illustrated in FIG. 8. For example, as described above, the dosing tube 234 may embody molybdenum-rhenium alloy, which is mechanically compressed via a crimping tool or other mechanical deformation tool to form a hermetical seal 299. In addition, localized heat, such as a laser, may be applied to the hermetical seal 299 to improve the bond and closure of the seal 299. Moreover, a seal material may be used to further improve the bond and close off the seal 299.

FIGS. 9, 10, 11 are exemplary systems in accordance with certain embodiments of the present technique. FIG. 9 illustrates an embodiment of a reflective lamp assembly 400 comprising the arc envelope assembly 200 of FIG. 8 in accordance with the present technique. As illustrated, the reflective lamp assembly 400 comprises an enclosure 402 having a curved reflective surface 404, a central rear passage or mounting neck 406, and a front light opening 408. The arc envelope assembly 200 is mounted in the mounting neck 406, such that light rays 412 are directed outwardly from the assembly 200 toward the generally curved reflective surface 404. The curved surface 404 then redirects the light rays 412 forward toward the front light opening 408 as indicated by arrows 414. At the front light opening 408, the illustrated reflective lamp assembly 200 also includes a transparent or translucent cover 410, which may be a flat or lens-shaped structure to focus and direct the light from the arc envelope assembly 200. Moreover, the cover 410 may include coloring, such as red, blue, green, or a combination thereof. In some embodiments, the reflective lamp assembly may include suitable electronic components for starting and operating the lamp. The electronic components may be housed in a separate housing or in an integrated housing with other reflective lamp assembly components and may include fixtures. The electronic components may further include a ballast circuit. In certain embodiments, the reflective lamp assembly 400 may be incorporated or adapted to a variety of applications, such as transportation systems, video systems, outdoor lighting systems, and so forth. For example, FIG. 10 illustrates an embodiment of a video projection system 420 comprising the reflective lamp assembly 400 illustrated in FIG. 9. By further example, FIG. 11 illustrates a vehicle 422, such as an automobile, having a pair of the reflective lamp assemblies 400 in accordance with certain embodiments of the present technique. Other embodiments of the reflective lamp assembly include but are not limited to reflective lamp assemblies for street lighting, industrial lighting, flood lighting, and specialty lighting including stage, studio and stadium lighting.

Turning now to FIGS. 12, 13, and 14, these figures illustrate exemplary processes for manufacturing the lamps and systems described above with reference to FIGS. 1-11. FIG. 12 is a flow chart illustrating a process 510 for manufacturing the lamp 10 in accordance with embodiments of the present technique. As illustrated, the process 510 comprises providing lamp components including a ceramic arc envelope and an end structure comprising niobium (block 512). At block 514, the process 500 comprises coupling lamp components in a configuration shielding the end structure from an interior cavity of the arc envelope. For example, the configuration may include a shielding member or plug, a portion of a dosing tube, a coating, or a combination thereof. The process 510 then proceeds to fill lamp components with dose material(s) including a material corrosive to Niobium (block 516). For example, the dosing materials may include mercury, sodium, indium, thallium, scandium, halides of rare earth elements such as dysprosium, holmium, thulium, and inert gases such as krypton, argon or xenon. The process step of filling lamp components with dosing material may comprise the act of cold dosing the lamp at high pressure with the dosing material. The evacuation and dosing material fill process may be performed by simply attaching the dosing tube to a suitable processing station, as opposed to handling the assembly in a dry box and/or furnace. The process 510 then proceeds to hermetically seal the lamp components (block 518). For example, the sealing process may include applying a seal material, localized heating, pressure (e.g., a crimping tool), or other sealing techniques at one or more joints between the lamp components.

FIG. 13 illustrates another process 520 for manufacturing the lamp 10 in accordance with embodiments of the present technique. As illustrated, the process 520 begins by coupling a niobium end structure to an open end of a ceramic arc envelope (block 522). For example, the end structure may be butt-sealed or sealed around an outer circumferential portion of the arc envelope using a suitable seal material. At block 524, the process 520 comprises positioning a dosing shield (e.g., a plug) between the niobium end structure and an interior cavity of the ceramic arc envelope. For example, the dosing shield may completely and continuously extend across the interior cavity adjacent the niobium end structure, thereby isolating the surface of the niobium end structure from the interior cavity. The process 520 proceeds by filling the lamp components with dose material(s) (block 526). The process then proceeds to hermetically seal lamp components (block 528).

FIG. 14 is a flow chart illustrating a process 530 for manufacturing the lamp 10 in accordance with embodiments of the present technique. As illustrated, the process 530 proceeds by coupling a niobium end structure to an open end of a ceramic arc envelope (block 332). At block 534, the process 530 comprises extending a dosing tube through the end structure and overlapping an inner perimeter of the ceramic arc envelope. In this manner, the overlapping portion of the dosing tube isolates or shields the niobium end structure from the interior cavity of the ceramic arc envelope. At block 536, the process 530 also may include positioning a dosing shield between the niobium end structure and an interior cavity of the ceramic arc envelope. The process 530 then proceeds by fitting an electrode and coil assembly into the dosing tube (block 538) and filling the lamp components with desired dose material(s) (block 540). The process 530 then proceeds to seal the lamp components (block 542). For example, the sealing process may include applying a seal material, localized heating, pressure (e.g., a crimping tool), or other sealing techniques at one or more joints between the lamp components.

FIG. 15 is a flow chart illustrating an exemplary process 550 of lamp operation in accordance with embodiments of the present technique. The process 550 reduces thermal stress via niobium end structures coupled to opposite ends of the arc envelope (block 552). For example, the niobium end structures reduce thermal shock in dynamic lighting applications, improve startup, help control cold spots near the opposite ends of the arc envelope, and provides mechanical stability to the arc envelope assembly. The process 550 also shields the niobium end structures corrosive portions (e.g., halides, sodium iodide, thallium iodide, dysprosium iodide, holmium iodide, and thulium iodide) from the dosing material via dosing tubes that overlap an inner perimeter of the arc envelope at the opposite ends (554). For example, the dosing tubes may comprise a molybdenum-rhenium tube, which has an outer circumference that is greater than an inner circumference of the arc envelope. As a result, the dosing tubes isolate or shield the surface of the niobium end structures from the interior cavity, thereby protecting the niobium end structures against chemical attack by the corrosive portions of the dosing material.

FIG. 16 is a flow chart illustrating an exemplary process 560 of lamp operation in accordance with embodiments of the present technique. The process 560 reduces thermal stress via niobium end structures coupled to opposite ends of the arc envelope (block 562). The process 560 also shields the niobium end structures corrosive portions from the dosing material via plugs disposed between the arc envelope and end structures, and overlapping an internal perimeter of the arc envelope covering an interior surface of the end structures and surrounding a portion of the dosing tubes. (564). As a result the dosing shields protect the niobium end structures against chemical attack by the corrosive portions of the dosing material.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A lamp, comprising:

an arc envelope;

a dosing material disposed within the arc envelope;

an end structure coupled to the arc envelope and shielded from the dosing material, wherein the end structure comprises niobium; and a dosing shield disposed between and isolating the end structure from an interior cavity of the arc envelope, wherein the dosing shield comprises a plug overlapping an internal perimeter of the arc envelope.

2. The lamp of claim 1, comprising a dosing tube extending through the end structure.

3. The lamp of claim 2, comprising a coil disposed in the dosing tube and an electrode disposed within or on the coil.

4. The lamp of claim 3, wherein the coil comprises a molybdenum-rhenium material.

5. The lamp of claim 2, wherein the dosing tube comprises an outer perimeter that overlaps an open end of the arc envelope.

6. The lamp of claim 2, wherein the dosing tube comprises a molybdenum-rhenium material.

7. The lamp of claim 1, comprising a compliant seal material disposed between an outer perimeter of the arc envelope and an inner perimeter of the end structure.

8. The lamp of claim 1, wherein the dosing material comprises a metal or a halide, or a metal halide, or mercury or sodium or sodium iodide or thallium iodide or dysprosium iodide or holmium iodide or thulium iodide or a noble gas, or argon or krypton or xenon, or combinations thereof.

9. The lamp of claim 1, wherein the dosing material is mercury-free.

10. A system, comprising:

an end structure comprising niobium;

a ceramic arc envelope coupled to the end structure;

a dosing material disposed within the arc envelope, wherein the dosing material comprises one or more first materials that are corrosive to niobium; and a configuration to shield the end structure from the dosing material, wherein the configuration comprises:

a dosing shield plug disposed between and isolating the end structure from an interior cavity of the ceramic arc envelope; or a dosing tube having an outer diameter greater than an inner diameter of the ceramic arc envelope, wherein the dosing tube is coupled to an open end of the ceramic arc envelope in a configuration having the outer diameter overlapping the inner diameter to isolate the end structure from the dosing material; or a combination thereof.

11. The system of claim 10, wherein the configuration comprises the dosing shield plug disposed between and isolating the end structure from the interior cavity of the ceramic arc envelope.

12. The system of claim 11, wherein the configuration comprises the dosing tube.

13. The system of claim 10, wherein the configuration comprises the dosing tube having the outer diameter greater than the inner diameter of the ceramic arc envelope, wherein the dosing tube is coupled to the open end of the ceramic arc envelope in the configuration having the outer diameter overlapping the inner diameter to isolate the end structure from the dosing material.

14. The lamp of claim 13, comprising a coil disposed in the dosing tube and an electrode disposed within or on the coil.

15. The system of claim 10, comprising a reflective lamp assembly including the lamp.

16. The system of claim 15, comprising a vehicle having the reflective lamp assembly.

17. The system of claim 10, comprising a video projector having the lamp.

18. The system of claim 10, wherein the dosing material excludes mercury.

19. A method of making a lamp, comprising the acts of:

sealing a ceramic arc envelope and a niobium end structure at an interface having a compliant seal material; and shielding the niobium end structure from a dosing material disposed within the ceramic arc envelope, wherein the act of shielding comprises including a dosing tube having an outer diameter greater than an inner diameter of the ceramic arc envelope and coupling the dosing tube to an open end of the ceramic arc envelope in a configuration having the outer diameter overlapping the inner diameter to isolate the niobium end structure from the dosing material.

20. The method of claim 19, wherein the act of shielding comprises including a ceramic plug in a position between and isolating the niobium end structure from an interior cavity of the ceramic arc envelope.

21. The method of claim 19, comprising extending the dosing tube through the niobium end structure, including a coil disposed inside the dosing tube, and including an electrode disposed within or on the coil.

22. The method of claim 21, wherein the dosing tube, or the coil, or both comprise a molybdenum-rhenium material.

23. The method claim 19, comprising the act of sealing the dosing tube via localized heating, or cold welding, or a combination thereof.

24. The method of claim 19, comprising the act of cold dosing the lamp at high pressure with the dosing material.

25. The method of claim 19, wherein the dosing material is mercury-free.

26. A method of operating a lamp comprising:

creating an electrical arc between a pair of electrode tips to initiate a discharge in a dosing material disposed within an arc envelope;

reducing thermal stress via niobium end structures coupled to opposite ends of the arc envelope; and shielding the niobium end structures from corrosive portions of the dosing material via a shielding configuration, wherein the shielding configuration comprises:

a dosing shield plug disposed between and isolating at least one of the niobium end structures from an interior cavity of the arc envelope; or a dosing tube having an outer diameter greater than an inner diameter of the arc envelope, wherein the dosing tube is coupled to an open end of the arc envelope in a configuration having the outer diameter overlapping the inner diameter to isolate at least one of the niobium end structures from the dosing material; or a combination thereof.

27. The method of claim 26, wherein the act of shielding comprises the act of disposing dosing tubes at the opposite ends, wherein each dosing tube has the outer diameter greater than the inner diameter of the arc envelope, and each dosing tube is coupled to a respective open end of the arc envelope in the configuration having the outer diameter overlapping the inner diameter to isolate the respective niobium end structure from the dosing material.

28. The method of claim 26, wherein the act of shielding comprises the act of disposing dosing shield plugs between and isolating the respective niobium end structures from the interior cavity of the arc envelope.

29. The method of claim 26, wherein the shielding configuration comprises the dosing shield plug disposed between and isolating at least one of the niobium end structures from the interior cavity of the arc envelope.

30. The method of claim 26, wherein the shielding configuration comprises the dosing tube having the outer diameter greater than the inner diameter of the arc envelope, wherein the dosing tube is coupled to the open end of the arc envelope in the configuration having the outer diameter overlapping the inner diameter to isolate at least one of the niobium end structures from the dosing material.

31. A method of making a lamp, comprising the acts of:

sealing a ceramic arc envelope and a niobium end structure at an interface having a compliant seal material; and shielding the niobium end structure from a dosing material disposed within the ceramic arc envelope, wherein the act of shielding comprises providing a ceramic plug in a position between and isolating the niobium end structure from an interior cavity of the ceramic arc envelope.

32. A lamp, comprising:

an arc envelope;

an end structure coupled to the arc envelope; and a dosing tube having an outer diameter greater than an inner diameter of the arc envelope, wherein the dosing tube is coupled to an open end of the arc envelope in a configuration having the outer diameter overlapping the inner diameter to isolate the end structure from an interior of the arc envelope.

33. The lamp of claim 32, comprising a dosing material within the interior of the arc envelope.

34. The lamp of claim 33, wherein the dosing material comprises a rare gas, a metal, a halide, a metal halide, mercury, or combinations thereof.

35. The lamp of claim 33, wherein the dosing material is mercury-free.

* * * * *

UNITED STATES PATENT AND TRADEMARK OFFICE

CERTIFICATE OF CORRECTION

PATENT NO. : 7,432,657 B2
APPLICATION NO. : 11/172651
DATED : October 7, 2008
INVENTOR(S) : Bewlay et al.

It is certified that error appears in the above-identified patent and that said Letters Patent is hereby corrected as shown below:

In Column 5, Line 64, delete “microgram” and insert -- micrograin --, therefor.

In Column 6, Line 8, delete “microgram” and insert -- micrograin --, therefor.

Signed and Sealed this

Twenty-first Day of April, 2009

John Doll

JOHN DOLL
*Acting Director of the United States Patent and Trademark Office*